US007065800B2

(12) United States Patent
Brown

(10) Patent No.: US 7,065,800 B2
(45) Date of Patent: Jun. 27, 2006

(54) CATCHER'S CHEST PROTECTOR

(75) Inventor: Robin J. Brown, Labadie, MO (US)

(73) Assignee: Rawlings Sporting Goods Company, Inc., Fenton, MO (US)

( * ) Notice: Subject to any disclaimer, the term of this patent is extended or adjusted under 35 U.S.C. 154(b) by 0 days.

(21) Appl. No.: 10/836,771

(22) Filed: Apr. 30, 2004

(65) Prior Publication Data

US 2005/0241052 A1 Nov. 3, 2005

(51) Int. Cl.
*A41D 13/00* (2006.01)

(52) U.S. Cl. ..... 2/463

(58) Field of Classification Search ..... 2/455, 2/459, 460, 461, 462, 463, 464, 468, 2.5
See application file for complete search history.

(56) References Cited

U.S. PATENT DOCUMENTS 5,007,108 A * 4/1991 Laberge et al. ..... 2/463
5,173,964 A * 12/1992 Ball et al. ..... 2/461
5,623,728 A * 4/1997 Wagner ..... 2/462
5,623,729 A * 4/1997 Chen ..... 2/461
6,021,528 A * 2/2000 Jurga et al. ..... 2/326
6,035,452 A 3/2000 Braxton
6,067,665 A * 5/2000 DePalma et al. ..... 2/468
6,161,226 A * 12/2000 Serewicz et al. ..... 2/459
6,182,299 B1 2/2001 Chen

* cited by examiner

*Primary Examiner*—Gary L. Welch
(74) *Attorney, Agent, or Firm*—Stinson Morrison Hecker LLP

(57) ABSTRACT

A catcher's chest protector that expands and contracts in response to the movements of a wearer. The chest protector comprises a padded main body configured to protect the wearer from the impact of a thrown ball, connected to a harness by a pair of elastic straps. The harness includes a collar configured to extend around the neck of the wearer and having a pair of laterally spaced collar ends that overlap or about the main body on either side of the wearer's neck to cover a portion of the wearer's shoulder.

22 Claims, 5 Drawing Sheets

CATCHER'S CHEST PROTECTOR

CROSS-REFERENCE TO RELATED APPLICATIONS

Not Applicable.

STATEMENT REGARDING FEDERALLY SPONSORED RESEARCH OR DEVELOPMENT

Not applicable.

BACKGROUND OF THE INVENTION

1. Field of the Invention

The present invention relates to the field of sports protective equipment, and more specifically to a catcher's chest protector that expands and contracts in response to a wearer's movements and to provide a better fit to wearers of various sizes.

2. Description of Related Art

Various types of chest protectors for baseball and softball catchers are well known in the sporting goods industry. Generally, chest protectors are comprised of a main padded portion shaped to overlay the wearer's chest and abdomen and designed to protect the wearer from being injured by the impact of a ball.

The main padded portion of known chest protectors is secured to the wearer by a plurality of straps. Typically, a set of straps extends over the wearer's shoulders and a set of straps extends around the wearer's sides. The two sets of straps extend to the wearer's back where the straps are secured to one another. While each set of straps is usually adjustable to provide a better fit, the straps do not adjust to movement by the wearer. Consequently, a chest protector that may comfortably fit a wearer in a static position will not provide a comfortable fit for a wearer during dynamic movements that occur throughout the game.

Accordingly, there is a need for a chest protector that accommodates and reacts to a wearer's dynamic movements during a game. Moreover, the chest protector must be suitable for wearers of many different sizes without compromising the wearer's mobility or flexibility.

BRIEF SUMMARY OF THE INVENTION

The present invention overcomes the disadvantages of the prior art by creating a catcher's chest protector that expands and contracts in response to a wearer's movements. The catcher's chest protector comprises a front padded main body that is connected along each shoulder of the wearer to a rear harness via elastic straps. The main body is configured to protect the wearer's chest and abdomen and to cover a front portion of the wearer's shoulders. The harness has a collar configured to extend around the neck of the wearer between laterally spaced collar ends. The collar ends overlap or abut the main body of the chest protector along either shoulder of the wearer. Elastic straps are secured to and extend between the main body and the collar ends to permit expansion of the chest protector at the juncture of the collar and main body.

In one embodiment of the invention, the main body includes a pair of laterally spaced main body extensions configured to extend upwardly and over the front portion of the shoulders of the wearer. A collar configured to extend around the neck of the wearer has a pair of laterally spaced collar ends that cover a back portion of the shoulders of the wearer and overlap or abut corresponding main body extensions. Elastic straps are secured between corresponding main body extensions and collar ends to elastically connect and permit relative movement between the extensions to the collar ends.

In a preferred embodiment, a sleeve is formed in each of the collar ends and the elastic straps are secured to the collar ends within the sleeve. Most preferably, the sleeve is configured to also receive an upper portion of the main body extension such that when the chest protector is in the retracted position, the elastic straps are substantially hidden. In a preferred embodiment, the sleeves are formed in each collar end by securing a front panel and a rear panel of the collar together along the outer side edges of the collar. The ends of the elastic straps are fitted within the sleeves between the front and rear panels and are attached to the interior side of the rear panel.

In a most preferred embodiment, two elastic straps are used to secure each main body extension to a corresponding collar end. In this embodiment, one end of a first elastic strap is attached to the front of the main body extension and the other end of the strap is secured within a sleeve in the collar end. A second elastic strap is attached to the rear of the main body extension and is also secured within the sleeve in the collar end.

In another aspect of the present invention, the harness additionally includes a belt and a center strap. The belt is configured to be removeably secured to the main body and the center strap is configured to connect the belt to the collar.

Additional aspects of the invention, together with the advantages and novel features appurtenant thereto, will be set forth in part in the description which follows, and in part will become apparent to those skilled in the art upon examination of the following, or may be learned from the practice of the invention. The objects and advantages of the invention may be realized and attained by means of the instrumentalities and combinations particularly pointed out in the appended claims.

DETAILED DESCRIPTION OF PREFERRED EMBODIMENT

Figure 1:
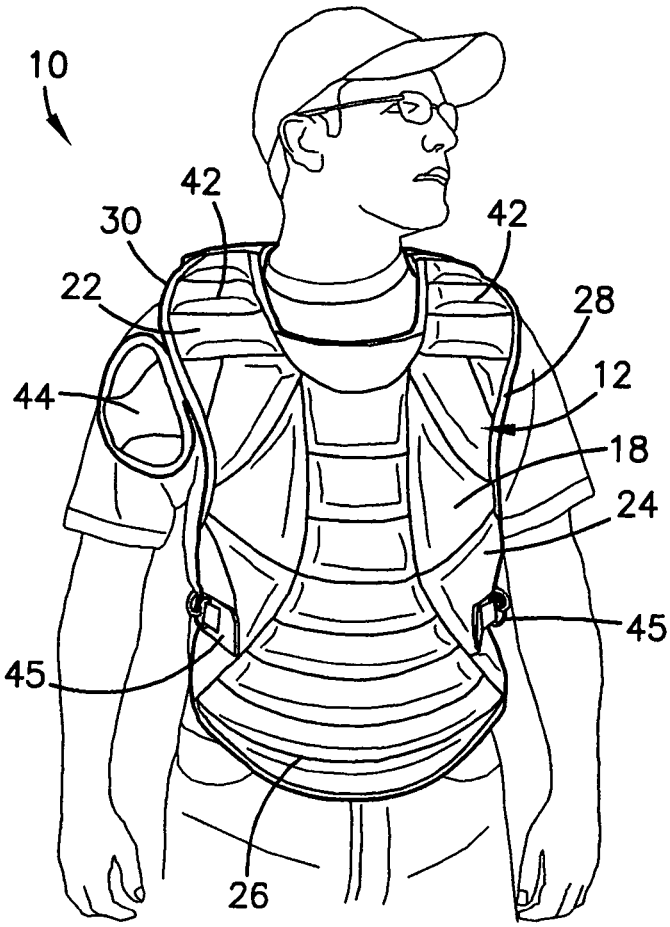
FIG. 1 is a front pictorial view of a catcher's chest protector in accordance with the present invention shown in use on a wearer.
Figure 2:
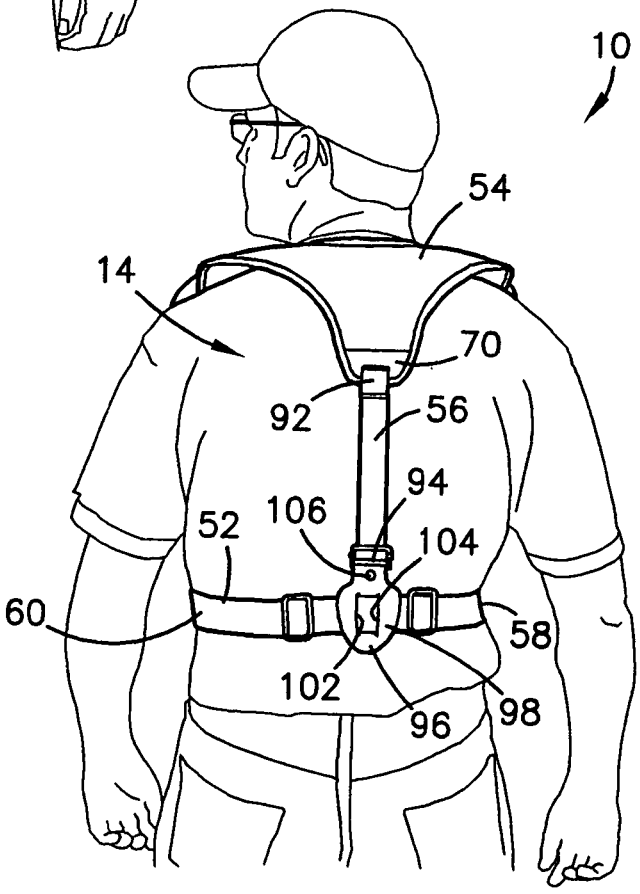
FIG. 2 is a rear pictorial view of the catcher's chest protector of FIG. 1 shown in use on a wearer.

A catcher's chest protector in accordance with the present invention is generally designated by the reference numeral 10. As shown in FIGS. 1–2, the chest protector 10 includes a main body 12 connected to a harness 14 along either shoulder of the wearer by a pair of elastic straps 78, 80. Main body 12 comprises padding positioned between a front sheet 18 and a rear sheet 20 that are secured together along their outer edges. (see FIGS. 7–8).

Front sheet 18 comprises a pair of side panels 22, 24 sewn along each side of a central panel 26. The panels can be made from any suitable material that can stand the wear and tear of repeated impacts of a thrown baseball. Particularly suitable materials for this purpose include ballistic nylon-polyester fabrics and nylon spandex fabrics.

Figure 7:
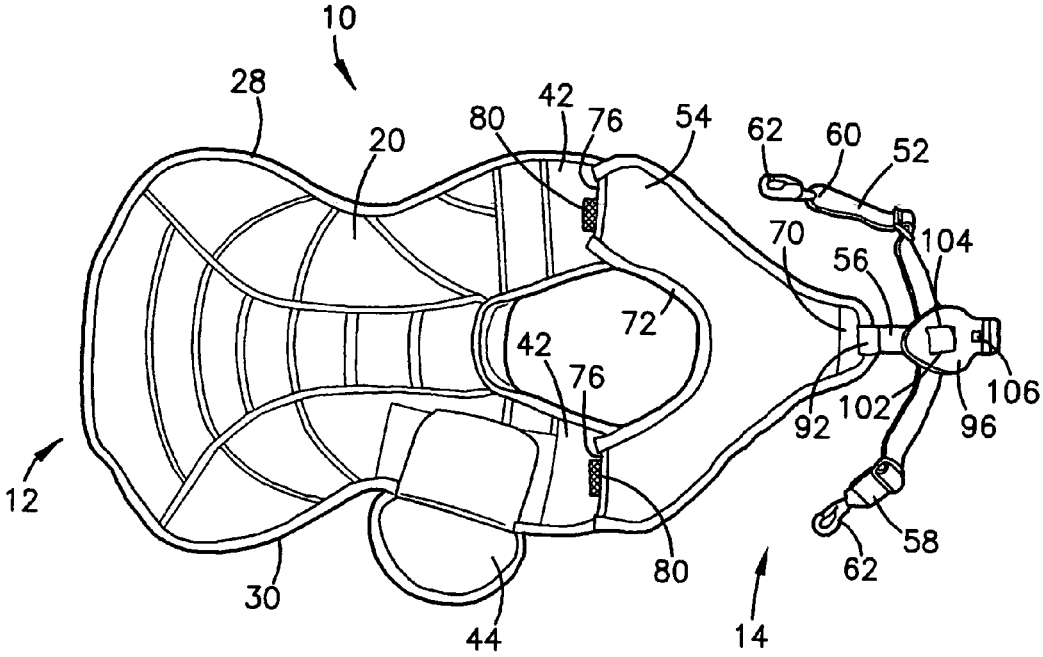
FIG. 7 is a rear view of the catcher's chest protector of FIG. 1 shown in a retracted position.
Figure 8:
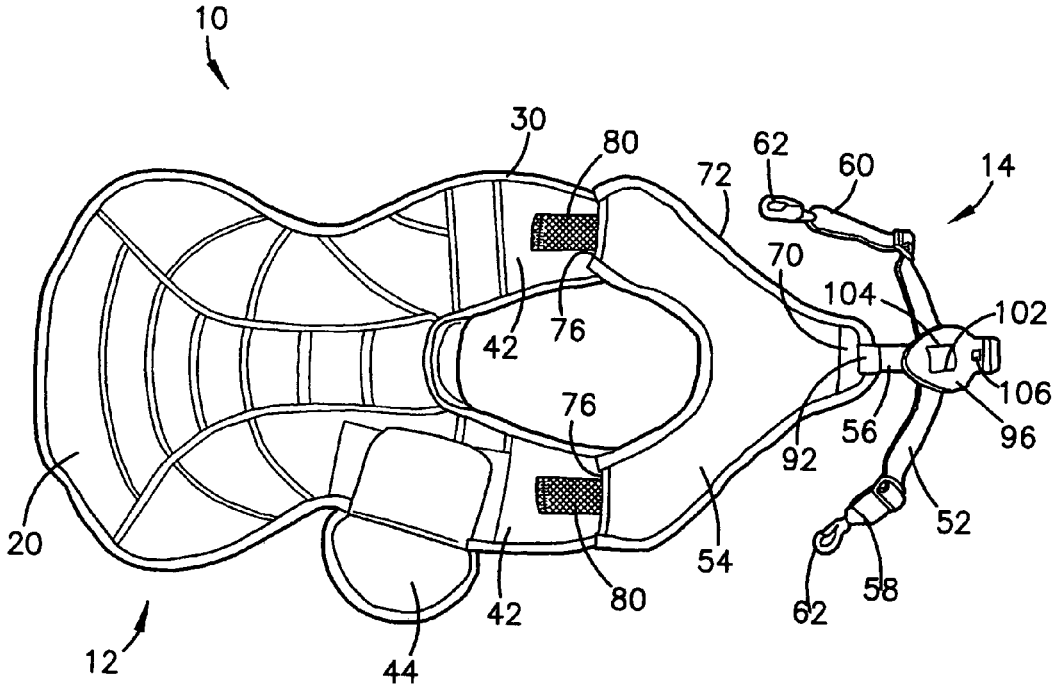
FIG. 8 is a rear view of the catcher's chest protector of FIG. 1 shown in an extended position.

As shown in FIGS. 7–8, rear sheet 20 is attached to front sheet 18 by an outer binding 28 sewn along outer edge 30 of main body 12. Rear sheet 20 can be formed of any suitable material and is preferably made from a breathable fabric. A suitable fabric for this purpose is commercially available under the trade name Coolmax®from DuPont of Charlotte, N.C.

Figure 3:
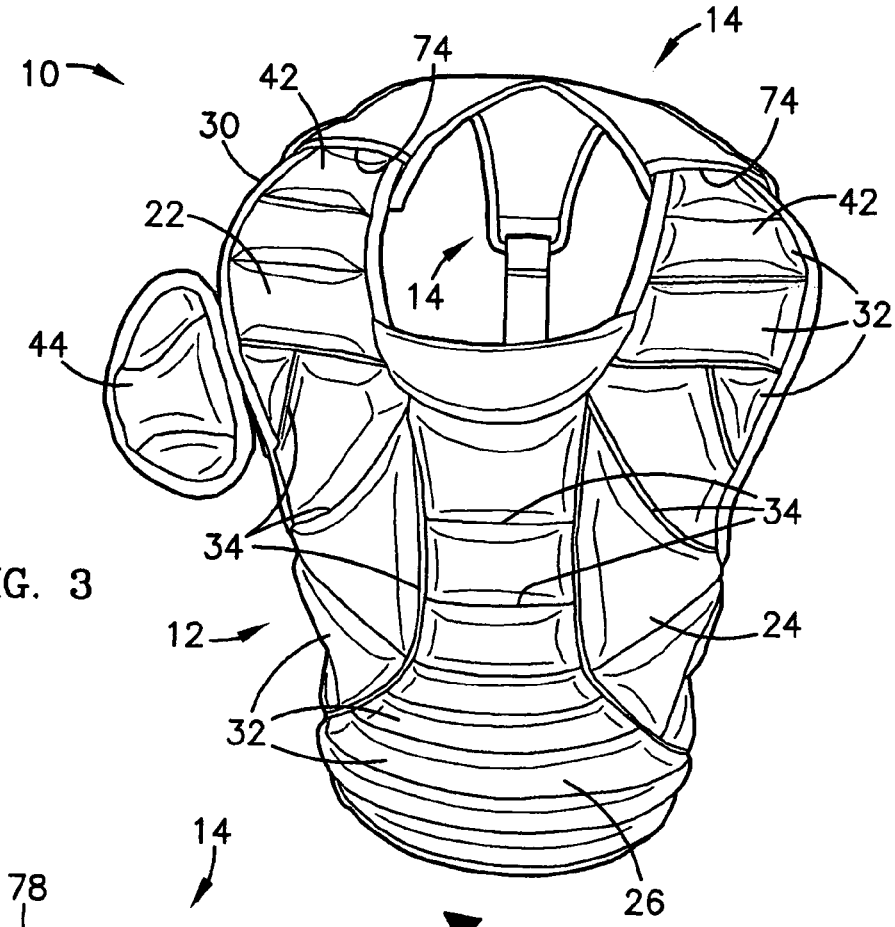
FIG. 3 is a perspective view of the catcher's chest protector of FIG. 1 shown in a retracted position.
Figure 4:
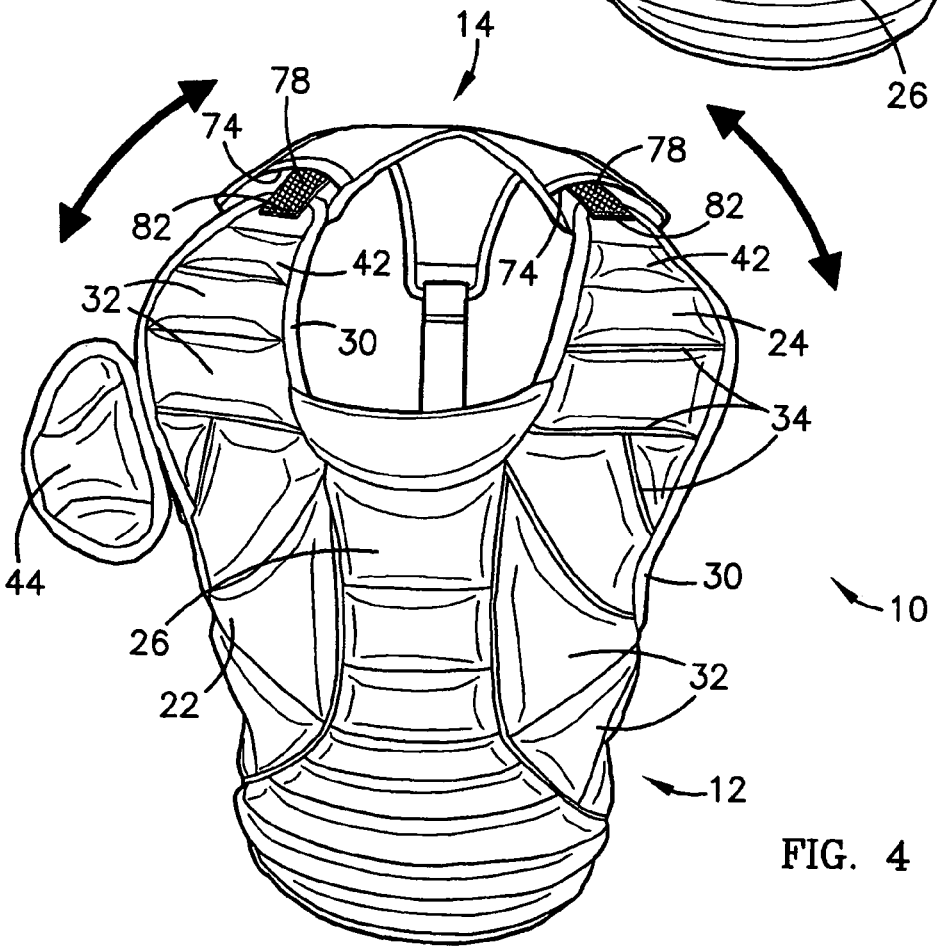
FIG. 4 is a perspective view of the catcher's chest protector of FIG. 1 shown in an extended position.

As shown in FIGS. 3–4, the padding material is preferably shaped into a desired pattern of individual pads 32 and channels 34 as is known in the art. In the embodiment shown, the channels 34 are formed by stitching the front and rear sheets 18, 20 together between pads 32. The pattern is preferably designed to allow the main padded portion 12 to flex in response to movements of the wearer. The padding can be any suitable shock absorbing material that provides protection to the wearer from the impact of a thrown baseball. In addition, the padding material may include inserts (not shown) made from materials such as fiberglass, plastic or other suitable material that can provide extra protection to critical areas (i.e., the collarbone and/or the sternum). In a preferred embodiment, the padding material located behind the side panels 22, 24 is made from EVA foam and the padding material located behind the center panel 26 is made from Visco-Elastic foam.

The main body 12 generally conforms in size and shape to cover the chest area and the abdomen of the wearer. The main body 12 includes an upper left side and an upper right side configured to cover a portion of a wearer's chest. The main body 12 may optionally include a lower section (not shown) for protecting the wearer's groin area. As shown in FIG. 1, the main body 12 includes a laterally spaced extensions 42 extending upwardly for disposition adjacent and over the top of the wearer's right and left shoulders.

As shown in FIGS. 1, 7–8, one or more shoulder covers 44 may optionally be integrally formed with or detachably secured to main body 12. Preferably, shoulder cover 44 is detachably secured to main body 12 so that it can be secured at different positions along the shoulder area in accordance with the preference of the wearer. Any type of fasteners may be used to attach the shoulder cover 44 to main body 12. In a preferred embodiment, hook and loop fasteners are affixed on the front of shoulder cover 44 and along a portion of back sheet 20 adjacent the shoulder area to detachably secure the shoulder cover 44 in place.

As shown in FIG. 1, a fastener 45 is provided along either side of main body 12 adjacent the rib cage or waist of the wearer to removeably connect the harness to the main body. Looking to FIG. 9, leather patch 46 is sewn along the outer edges of side panels 22, 24. Fabric loop 48 is sewn to the patch and a metal ring 50 is secured through the loop. The metal ring 50 is configured to secure a quick release fastener on harness 14 as hereafter described. It will be appreciated that any other suitable fasteners can be used to removeably connect the harness 14 to main body 12, including hook and loop fasteners, snaps, buttons, buckles or any equivalents thereof.

As shown in FIGS. 2, 7–9, harness 14 comprises belt 52 connected to a Y-shaped collar 54 by a center strap 56. Belt 52 is preferably a conventional adjustable elastic or leather belt that extends around the wearer's waist and fastens to each of the waist patches 46 (see FIG. 9). Belt 52 includes first and second ends 58, 60, with the each end having a quick release fastener 62 secured thereto that may be removeably secured to one of the rings 50. As noted previously, any other suitable fasteners can be used to secure belt 52 to the main padded portion 12.

Figure 5:
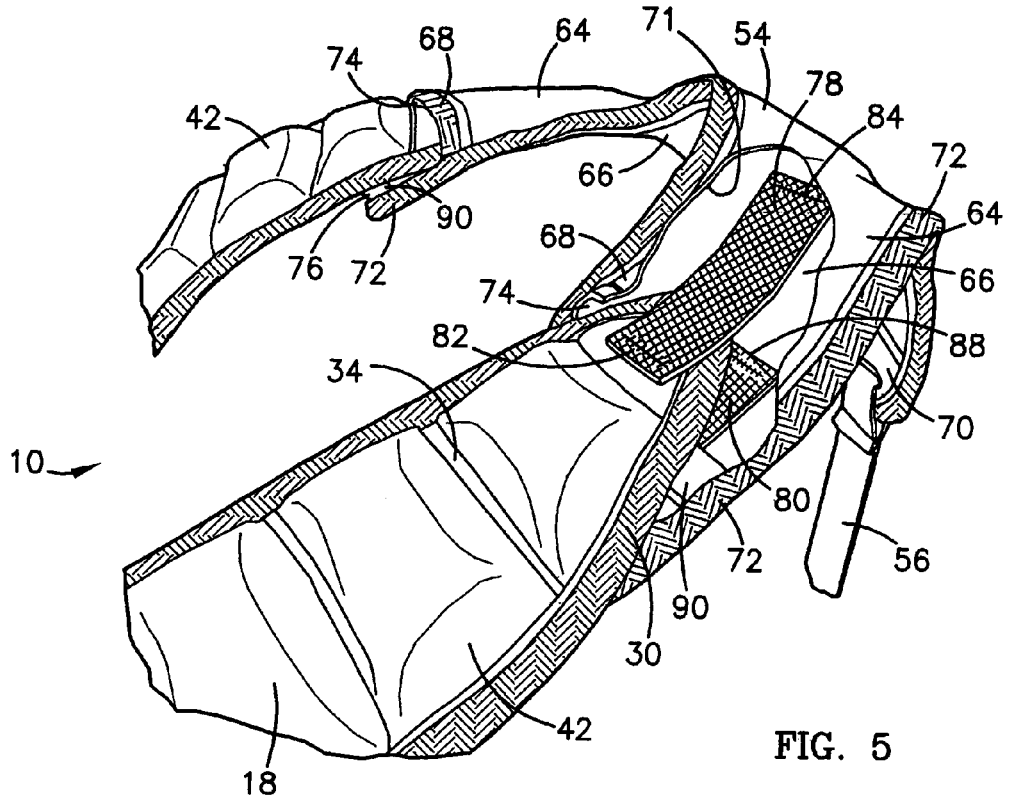
FIG. 5 is a fragmentary perspective view of the catcher's chest protector of FIG. 1, showing the elastic straps connected to the harness and to the main padded portion, with a portion of the harness cut away for clarity.
Figure 6:
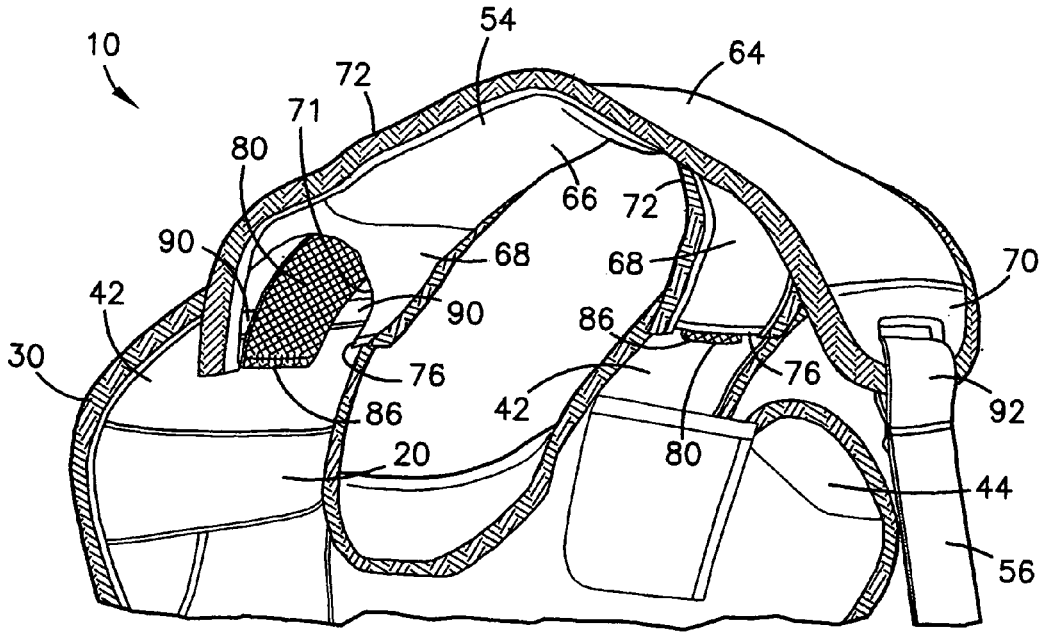
FIG. 6 is a fragmentary perspective view of the catcher's chest protector of FIG. 1, showing the elastic straps connected to the harness and to the main padded portion, with a portion of the harness cut away for clarity.

As shown in FIGS. 5–6, Y-shaped collar 54 is configured to extend around the neck of the wearer with a centrally located bottom end 70 extending downwardly along the wearer's back and two laterally spaced collar ends 68 that cover a portion of each shoulder.

Collar 54 is constructed of a front collar panel 64 and rear collar panel 66 secured together along their outer side edges by an outer binding 72. The front panel 64 is preferably made from the same material as side panels 22, 24 of front sheet 18. The rear panel 66 is preferably made from the same material as rear sheet 20. Front panel 64 and rear panel 66 together define an internal sleeve 71 therebetween. The sleeve 71 includes an opening 76 at each of the collar ends 68 that provides access to the interior of the sleeve 71. Each opening 76 is positioned to correspond with one of the laterally spaced main body extensions 42.

The Y-shaped collar 54 also includes a pair of divider bands 90. Each divider band 90 laterally spans across one of the openings 76 and is attached to the rear panel 66 at or near the outer binding 72. The front panel 64 and the divider bands 90 define slots 74 at each of the collar ends 68. An upper portion of the main body extension 42 is configured to be inserted into opening 76 though slot 74.

As shown in FIGS. 3–4, at least one elastic strap 78 or panel (not shown) connects the Y-shaped collar 54 to the main body 12. The elastic strap 78 or panel is configured to permit the chest protector 10 to expand and contract at the juncture of the collar 54 and the main body 12. FIG. 3 shows the chest protector 10 in a retracted position. FIG. 4 shows the chest protector 10 in an extended position.

As shown in FIGS. 5–6, in a preferred embodiment, a pair of first elastic straps 78 extend from the upper right and upper left sides of the main padded body 12 to a corresponding collar end 68. The first elastic straps 78 each include a first end 82 and a second end 84. The first ends 82 are attached at or near the upper edge of main body extensions 42 by stitching or the like. Preferably, first ends 82 are attached to the front panel 18 of main body extensions 42. The first elastic straps 78 each extend from a main body extension 42 through a corresponding slot 74 into sleeve 71. The second ends 84 are located within sleeve 71 and are preferably attached to the interior of rear panel 66 by stitching or the like.

In a most preferred embodiment, two elastic straps 78, 80 preferably extend from each of the main body extensions 42 to a corresponding collar end 54. The second elastic straps 80 include a first end 86 and a second end 88. First end 86 is vertically spaced from the first end 82 of the first elastic strap 78 and is attached to the rear sheet 20 of main body extension 42 by stitching or the like. Preferably, first end 86 is attached to the main body extension 42 in a location corresponding to a channel 34. The second elastic strap 80 extends from a main body extension 42 through a corresponding opening 76 into the sleeve 71. The second end 88 is preferably attached to an interior face of the rear panel 66 by stitching or the like at a location spaced apart from the second end 84 of the first elastic strap 78.

Figure 9:
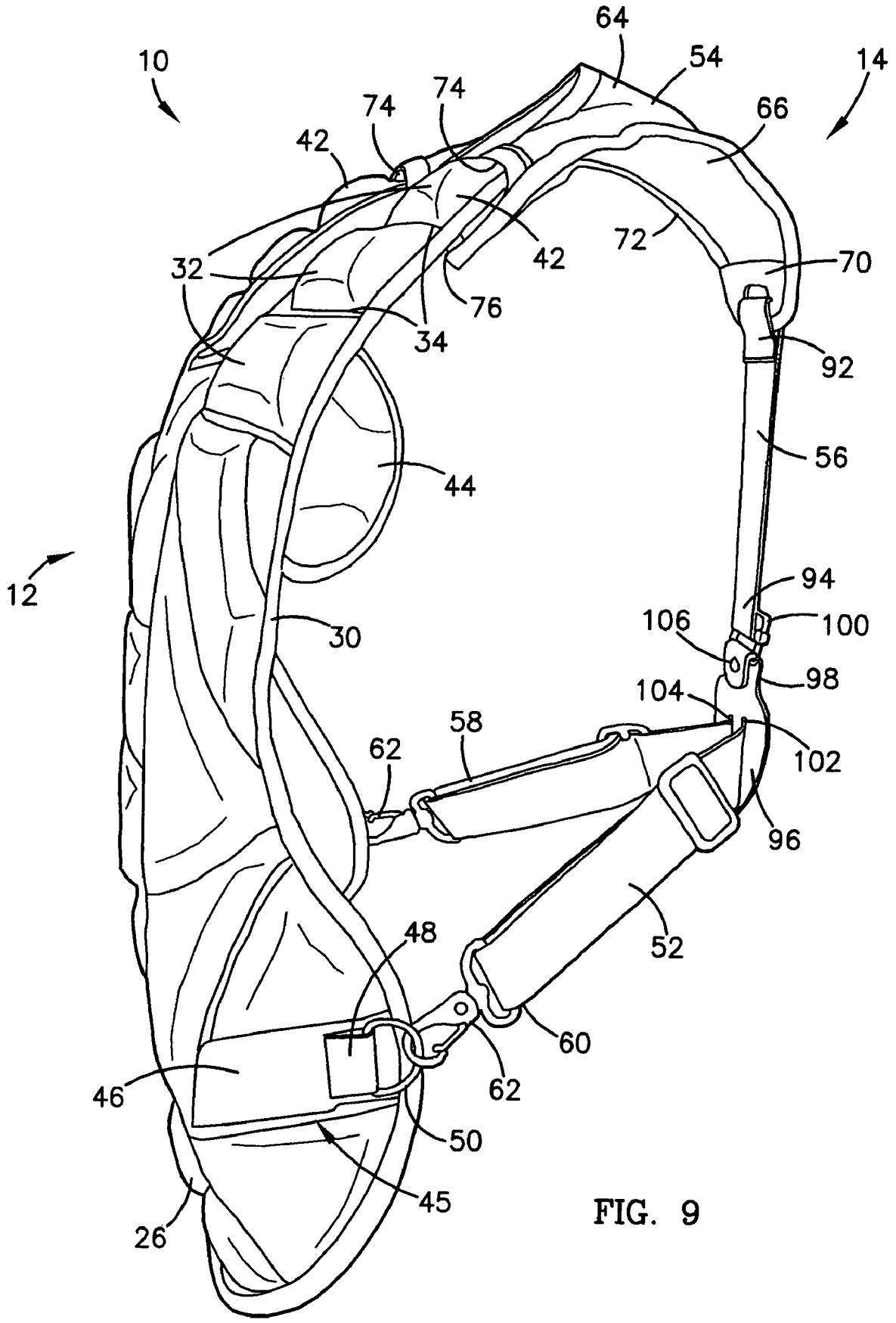
FIG. 9 is a side view of the catcher's chest protector of FIG. 1, shown in a retracted position.

As shown in FIGS. 7–9, center strap 56 is an adjustable strap that includes a first end 92 attached to bottom end 70 of Y-shaped collar 54, and a second end 94 that is secured to belt 52 by a strap stay 96. Center strap 56 is preferably made from a substantially inelastic woven material. It should be understood that center strap 56 could also be made from leather, elastic or other suitable material.

The first end 92 of center strap 56 is preferably looped through a hole in Y-shaped collar 54 and attached to itself by stitching or the like. The second end 94 is preferably attached to an upper portion 98 of strap stay 96. Strap stay 96 also includes two vertical slots 102, 104 through which belt 52 is inserted. As shown in FIG. 9, the upper portion 98 of strap stay 96 is preferably looped through a clasp 100 attached to second end 94 of center strap 56 and attached to itself by a rivet 106. It will be appreciated that any suitable fastener could be used to secure the upper portion 98 of strap stay 96 together.

As shown in FIGS. 1–2, a wearer puts the chest protector 10 on by inserting his or her head into the space defined between the main body extensions 42 and the Y-shaped collar 54. To provide additional space, the Y-shaped collar 54 is pulled away from the main body extensions 42 causing the elastic straps 78, 80 to stretch and allow the main body 12 and the harness 14 to move apart into an extended position. As the force pulling on the Y-shaped collar 54 is reduced, the elastic straps 78, 80 retract causing the main body 12 and the harness 14 to move together into a retracted position.

As shown in FIGS. 5, 9, when the chest protector 10 is in the retracted position, the straps 78, 80 are preferably hidden within the sleeves 71 of the Y-shaped collar 54. The first elastic straps 78 and the upper portions of the main body extensions 42 are received within the sleeves 71 of the Y-shaped collar 54 through the slots 74. Thus, the main body extensions 42 partially overlap the openings 76 of the collar ends 68. As shown in FIG. 6, the second elastic straps 80 are received within the sleeves 71 of the Y-shaped collar 54 through the openings 76. Only small portions of the second elastic straps 80 are located outside the openings 76. As shown in FIG. 4, as the chest protector 10 moves into the extended position, the main body extensions 42 and a portion of the first elastic straps 78 are pulled outside the sleeves 71. Thus, in the extended position, only a small portion of the main body extension 42 overlaps with the Y-shaped collar 54. As shown in FIG. 8, as the chest protector 10 moves into the extended position, a much larger portion of the second elastic strap 80 is pulled outside the sleeve 71.

From the foregoing, it will be seen that this invention is one well adapted to attain all ends and objectives hereinabove set forth, together with the other advantages which are obvious and which are inherent to the invention.

Since many possible embodiments may be made of the invention without departing from the scope thereof, it is to be understood that all matters herein set forth are to be interpreted as illustrative, and not in a limiting sense.

What is claimed and desired to be secured by letters patent is as follows:

1. A catcher's chest protector configured to protect a wearer's chest and abdomen comprising:

a padded main body having an upper left side and an upper right side configured to cover a portion of a wearer's upper chest;

a collar configured to extend around a wearer's neck and having left and right laterally spaced ends configured to cover a portion of a wearer's shoulders respectively;

an elastic strap having a first end secured to one of said upper sides of said main body and a second end secured to a corresponding end of said collar, wherein said elastic strap extends laterally to allow said collar and said main body to move relative to one another.

2. The catcher's chest protector of claim 1, wherein said chest protector comprises:

a first elastic strap having a first end secured to the left side of said main body and a second end secured to the left laterally spaced end of said collar; and a second elastic strap having a first end secured to the right side of said main body and second end secured to the right laterally spaced end of said collar.

3. The catcher's chest protector of claim 2, wherein said left and right laterally spaced ends each define an opening configured to receive the second ends of said first and second elastic straps respectively.

4. The catcher's chest protector of claim 1, wherein said collar is Y-shaped.

5. The catcher's chest protector of claim 1, wherein said chest protector has an extended position and a retracted position, and wherein said elastic straps are substantially hidden in said retracted position.

6. The catcher's chest protector of claim 5, wherein each said collar end has an internal sleeve configured to receive respective first and second elastic straps.

7. The catcher's chest protector of claim 6, wherein said upper left and right sides of said main padded portion comprise laterally spaced extensions that are adjacently disposed to the left and right shoulder of the wearer respectively and include an upper edge, wherein each of said first ends of said elastic straps are attached at or near said upper edge of said extensions.

8. The catcher's chest protector of claim 7, wherein said sleeve is configured to also receive a portion of said extensions.

9. The catcher's chest protector of claim 7, further comprising:

a third elastic strap having a first end secured to the left side extension and a second end secured to the left laterally spaced end of said collar; and a fourth elastic strap having a first end secured to the right side extension and a second end secured to the right laterally spaced end of said collar.

10. The catcher's chest protector of claim 9, wherein the first ends of said first and second elastic straps are attached to a front sheet of said main padded portion, and wherein said first ends of said third and fourth elastic straps are attached to a rear sheet of said main padded portion.

11. The catcher's chest protector of claim 10, wherein said first ends of said first and second elastic straps are vertically spaced from said first ends of said third and fourth elastic straps respectively.

12. The catcher's chest protector of claim 9, wherein said collar comprises a front panel and a rear panel secured together along outer side edges of said collar, and wherein said second ends of said first, second, third and fourth elastic straps are positioned between said front and rear panels.

13. The catcher's chest protector of claim 12, wherein said second ends of said first, second, third and fourth elastic straps are secured to an interior face of said rear panel of the collar.

14. The catcher's chest protector of claim 1, further comprising a belt configured to be removeably secured to said main padded portion and a center strap having a first end attached to said collar and a second end attached to said belt.

15. The catcher's chest protector of claim 1, wherein said collar comprises a front panel and a rear panel secured together along outer side edges of said collar, and wherein said second ends of said first and second elastic straps are positioned between said front and rear panels.

16. The catcher's chest protector of claim 15, wherein said second ends of said first and second elastic straps are secured to an interior face of said rear panel of the collar.

17. A catcher's chest protector configured to protect a wearer's chest and abdomen comprising:

a main padded portion; and a collar attached to said main padded portion by an elastic means for expanding and contracting in response to a wearer's movements, wherein said elastic means allows said collar to extend laterally from said main portion.

18. The catcher's chest protector of claim 17, wherein said elastic means includes at least one pair of elastic straps.

19. The catcher's chest protector of claim 17, wherein said elastic means includes at least two pair of elastic straps.

20. The catcher's chest protector of claim 19, wherein said chest protector has an extended position and a retracted position and wherein said elastic straps are substantially hidden in said retracted position.

21. A catcher's chest protector configured to protect a wearer's chest and abdomen comprising:

a padded main body having an left side extension and an right side extension that are adjacently disposed to the left and right shoulders of the wearer respectively;

a collar elastically connected to said main padded body, wherein said collar is configured to extend around a wearer's neck and has left and right laterally spaced ends configured to cover a portion of the left and right shoulders of the wearer respectively, and wherein said main padded body and said collar are elastically connected for relative lateral movement between a juncture of said side extensions and said collar ends.

22. The catcher's chest protector of claim 21, wherein said left side extension is elastically connected to said left collar end and said right side extension is elastically connected to said right collar end.

* * * * *